US008206194B2

(12) United States Patent
Mori et al.

(10) Patent No.: US 8,206,194 B2
(45) Date of Patent: Jun. 26, 2012

(54) METHOD FOR AFFIXING THE INSULATOR AND THE METALLIC SHELL OF A SPARK PLUG

(75) Inventors: Kazuhiko Mori, Aichi-ken (JP); Makoto Yamaguchi, Aichi-ken (JP)

(73) Assignee: NGK Spark Plug Co., Ltd. (JP)

( * ) Notice: Subject to any disclaimer, the term of this patent is extended or adjusted under 35 U.S.C. 154(b) by 0 days.

(21) Appl. No.: 12/944,827

(22) Filed: Nov. 12, 2010

(65) Prior Publication Data

US 2011/0107588 A1 May 12, 2011

(30) Foreign Application Priority Data

Nov. 12, 2009 (JP) ..... 2009-258727

(51) Int. Cl.
*H01T 21/02* (2006.01)

(52) U.S. Cl. ..... 445/7; 313/118

(58) Field of Classification Search ..... 313/118–145; 123/169 R, 169 EL, 32, 34, 310; 445/7
See application file for complete search history.

(56) References Cited

U.S. PATENT DOCUMENTS

| | | | | |
|---|---|---|---|---|
| 6,548,945 | B1 | 4/2003 | Tamura | 313/141 |
| 2004/0078972 | A1 * | 4/2004 | Hanai | 29/857 |
| 2004/0145290 | A1 * | 7/2004 | Ando et al. | 313/143 |
| 2008/0092838 | A1 | 4/2008 | Takeuchi et al. | 123/169 |

* cited by examiner

*Primary Examiner* — Tracie Y Green
(74) *Attorney, Agent, or Firm* — Kusner & Jaffe

(57) ABSTRACT

A process of manufacturing the spark plug that includes a step in which a receiving die having an insertion hole and a taper portion is used, wherein a thread portion of the spark plug is inserted into the insertion hole and a seat portion of the spark plug is brought into contact with the taper portion, and a pressing force is applied to a rear end portion of a metallic shell of the spark plug so as to bend a rear end opening portion of the metallic shell, and to thereby form a crimped portion, whereby an insulator and the metallic shell are fixed together.

6 Claims, 7 Drawing Sheets

METHOD FOR AFFIXING THE INSULATOR AND THE METALLIC SHELL OF A SPARK PLUG

FIELD OF THE INVENTION

The present invention relates to a method of manufacturing a spark plug used for an internal combustion engine, etc.

BACKGROUND OF THE INVENTION

A spark plug is attached to a combustion apparatus such as an internal combustion engine, and is used to ignite an air-fuel mixture within a combustion chamber. In general, such a spark plug includes an insulator having an axial hole extending in an axial direction, a center electrode inserted into the axial hole, and a tubular metallic shell attached to the outer circumference of the insulator. The metallic shell has, on its outer circumferential surface, a thread portion which is screwed into an attachment hole of the combustion apparatus, a cylindrical tubular thread neck portion extending rearward from the rear end of the thread portion, and a seat portion which is provided on the rear end side of the thread neck portion and which comes into contact with the combustion apparatus indirectly via a ring-shaped gasket (see, for example, Japanese Patent Application Laid-Open (kokai) No. 2008-108478).

In general, the metallic shell and the insulator are fixed together by means of crimping before the gasket is provided. More specifically, in a state in which the insulator is inserted into the metallic shell, a front end portion of the metallic shell is first inserted into an insertion hole of a receiving die, whereby the metallic shell is held by the receiving die. At that time, the seat portion comes into surface contact with an area around an opening portion of the insertion hole. Subsequently, with an annular pressing die, a load along the axial direction is applied to a rear-end-side opening portion of the metallic shell. As a result, the rear-end-side opening portion of the metallic shell is bent radially inward so as to form a crimped portion, which is engaged with a large diameter portion of the insulator, which portion swells radially outward. As a result, the metallic shell and the insulator are fixed together.

Incidentally, in order to realize a further improvement in airtightness, there has been proposed a method of bringing the seat portion into direct and close contact with a combustion apparatus without provision of a gasket (see, for example, Japanese Patent Application Laid-Open (kokai) No. 2001-118659). That is, the seat portion is tapered off axially frontward, and the tapered seat portion is brought into surface contact with the combustion apparatus, whereby the sealing performance of the seal portion against the combustion apparatus can be enhanced, and, as a result, airtightness can be improved further.

However, in the case where the seat portion is tapered off frontward, when a load is applied to the metallic shell for crimp fixing, the material of the seat portion may deform radially inward along a contact surface of the receiving die. Therefore, the material of the seat portion may partially enter the insertion hole of the receiving die, resulting in biting of the metallic shell against the receiving die. If biting of the metallic shell occurs, extra labor is needed to remove the metallic shell from the receiving die, which may lower productivity. Furthermore, as a result of partial entry of the material of the seat portion into the insertion hole, a mark is formed on the seat portion, which may lower yield.

The present invention has been accomplished in view of the foregoing. An advantage of the present invention is a method of manufacturing a spark plug which can effectively suppress biting of a metallic shell against a receiving die, which would otherwise occur when the metallic shell and an insulator are fixed together, to thereby improve productivity, etc.

SUMMARY OF THE INVENTION

Hereinbelow, configurations suitable for achieving the above-described advantages will be described in an itemized fashion. Notably, when necessary, action and effects peculiar to each configuration will be added.

Configuration 1. In accordance with a first aspect of the present invention, there is provided a method of manufacturing a spark plug having a tubular insulator extending in a direction of an axis and a tubular metallic shell fixed to an outer circumference of the insulator, wherein the metallic shell includes a thread portion to be screwed into an attachment hole of a combustion apparatus, and a seat portion located rearward of the thread portion, and the seat portion comes into close contact with the combustion apparatus when the thread portion is screwed into the attachment hole of the combustion apparatus. The spark plug manufacturing method comprises a fixing step in which a receiving die having an insertion hole into which the thread portion can be inserted and a taper portion adjacently surrounding an opening of the insertion hole is provided. The thread portion is inserted into the insertion hole and the seat portion is brought into contact with the taper portion. In this state, a pressing force is applied along the axis against a rear end portion of the metallic shell so as to bend a rear end opening portion of the metallic shell radially inward, to thereby form a crimped portion, whereby the insulator and the metallic shell are fixed together. In the fixing step, the pressing force is applied to the rear end portion of the metallic shell in a state in which, as viewed on a cross-section including the axis, the angle between the taper portion and the seat portion is made equal to or greater than 0.5°.

According to the above-described configuration 1, in the fixing step for fixing the metallic shell and the insulator together, a pressing force is applied to the rear end portion of the metallic shell in a state in which, as viewed on a cross-section including an axis, the angle between the taper portion and the seat portion is made equal to or greater than 0.5°. That is, the seat portion of the metallic shell comes into line contact with the taper portion of the receiving die in an annular region, rather than coming into surface contact with the taper portion. Accordingly, when a pressing force is applied to the metallic shell along the axis, the greater part of the applied force is used to press the seat portion against the taper portion to thereby compressively deform the seat portion. Therefore, radially inward deformation of the material of the seat portion can be prevented more reliably, whereby biting of the metallic shell against the receiving die can be prevented more reliably. As a result, after the fixing step, the metallic shell can be readily and more easily removed from the receiving die, whereby productivity can be improved.

Moreover, since biting of the metallic shell against the receiving die can be prevented, formation of a mark on the seat portion can be prevented more reliably. That is, according to the above-described configuration 1, in addition to productivity, yield can be improved.

Configuration 2. In accordance with another aspect of the present invention, there is provided a spark plug manufacturing method as described above, wherein an outer diameter of the front end of the seat portion is made greater than an inner diameter of a boundary portion between the insertion hole and the taper portion by 0.1 mm to 0.8 mm inclusive.

According to the above-described configuration 2, the outer diameter of the front end of the seat portion is made greater than the inner diameter of the boundary portion between the insertion hole and the taper portion by 0.1 mm or greater. That is, in the fixing step, a sufficiently large clearance is formed between the insertion hole and a portion of the seat portion which is pressed against the taper portion and deforms. Therefore, even in the case where the material of the seat portion deforms radially inward upon application of a load onto the metallic shell, it is possible to more reliably prevent the material of the seat portion from reaching the insertion hole. As a result, biting of the metallic shell against the receiving die can be prevented more reliably, whereby productivity and yield can be improved further.

Incidentally, the area of the seat portion decreases when the outer diameter of the front end of the seat portion is increased. Accordingly, if the outer diameter of the front end of the seat portion is made excessively large, the contact area between the seat portion and the combustion apparatus becomes insufficient, whereby airtightness may deteriorate.

In contrast, according to the above-described configuration 2, the diameter difference between the outer diameter of the front end of the seat portion and the inner diameter of the boundary portion between the insertion hole and the taper portion is made equal to or less than 0.8 mm. Therefore, the area of the seat portion can be secured sufficiently, whereby deterioration of airtightness of a manufactured spark plug can be prevented more reliably.

Configuration 3. In accordance with another aspect of the present invention, there is provided a spark plug manufacturing method as described above, wherein the outer diameter of the front end of the seat portion is made greater than the inner diameter of the boundary portion between the insertion hole and the taper portion by 0.3 mm or greater.

According to the above-described configuration 3, since the outer diameter of the front end of the seat portion is made greater than the inner diameter of the boundary portion between the insertion hole and the taper portion by 0.3 mm or greater, a very large clearance is formed between the insertion hole and a portion of the seat portion which is pressed against the taper portion and deforms. Therefore, it is possible to effectively prevent the material of the seat portion from reaching the insertion hole, whereby biting of the metallic shell against the receiving die can be prevented more reliably.

Configuration 4. In accordance with another aspect of the present invention, there is provided a spark plug manufacturing method as described in the above-mentioned configurations 1 to 3, wherein the pressing force is applied to the rear end portion of the metallic shell in a state in which, as viewed on a cross-section including the axis, the angle between the taper portion and the seat portion is made equal to or less than 9.0°.

According to the above-described configuration 4, since the angle between the taper portion and the seat portion is made equal to or less than 9.0°, the seat portion can be deformed into a shape corresponding to that of the taper portion more reliably. Therefore, in particular, in the case where the spark plug is configured such that a portion of the seat portion that is deformed along the taper portion comes into close contact with the combustion apparatus, the contact area between the seat portion and the combustion apparatus can be secured sufficiently. As a result, in a manufactured spark plug, better airtightness can be realized.

Configuration 5. In accordance with still another aspect of the present invention, there is provided a spark plug manufacturing method as described in the above-mentioned configurations 1 to 4, wherein the pressing force is applied to the rear end portion of the metallic shell in a state in which, as viewed on a cross-section including the axis, the angle between the taper portion and the seat portion is made equal to or greater than 1.0°.

According to the above-described configuration 5, the angle between the taper portion and the seat portion (as viewed on a cross-section including the axis), is made equal to or greater than 1.0°. Therefore, when a pressing force along the axis is applied to the metallic shell, a larger portion of the applied force is used to press the seat portion against the taper portion, to thereby compressively deform the seat portion. As a result, radially inward deformation of the material of the seat portion can be prevented more effectively, whereby productivity and yield can be improved further.

Configuration 6. In accordance with yet another aspect of the present invention, there is provided a spark plug manufacturing method as described in the above-mentioned configurations 1 to 5, wherein the thread portion has a thread diameter of 12.0 mm or less.

In recent years, in order to meet a demand for reducing the size of spark plugs, the diameter of the metallic shell has been reduced. However, when the diameter of the metallic shell is reduced, the contact area between the seat portion and the taper portion decreases. Therefore, the pressure which acts on the seat portion upon application of a pressing force to the metallic shell increases further, and the material of the seat portion becomes more likely to deform radially inward. That is, in the case of a metallic shell having a reduced diameter, biting of the metallic shell against the receiving die is more likely to occur in the fixing step.

The metallic shell characterized in the above-described configuration 6 is such that the thread portion has a relatively small thread diameter of 12.0 mm or less, and biting of the metallic shell against the receiving die is more likely to occur. However, through employment of the above-described configuration 1, etc., biting of the metallic shell against the receiving die can be prevented effectively even in the case where the metallic shell has a reduced diameter. In other words, employment of the above-described configuration 1, etc. is meaningful in the case where a metallic shell whose thread portion has a reduced thread diameter of 12.0 mm or less and an insulator are fixed together.

DETAILED DESCRIPTION OF PREFERRED EMBODIMENTS

First Embodiment

Figure 1:
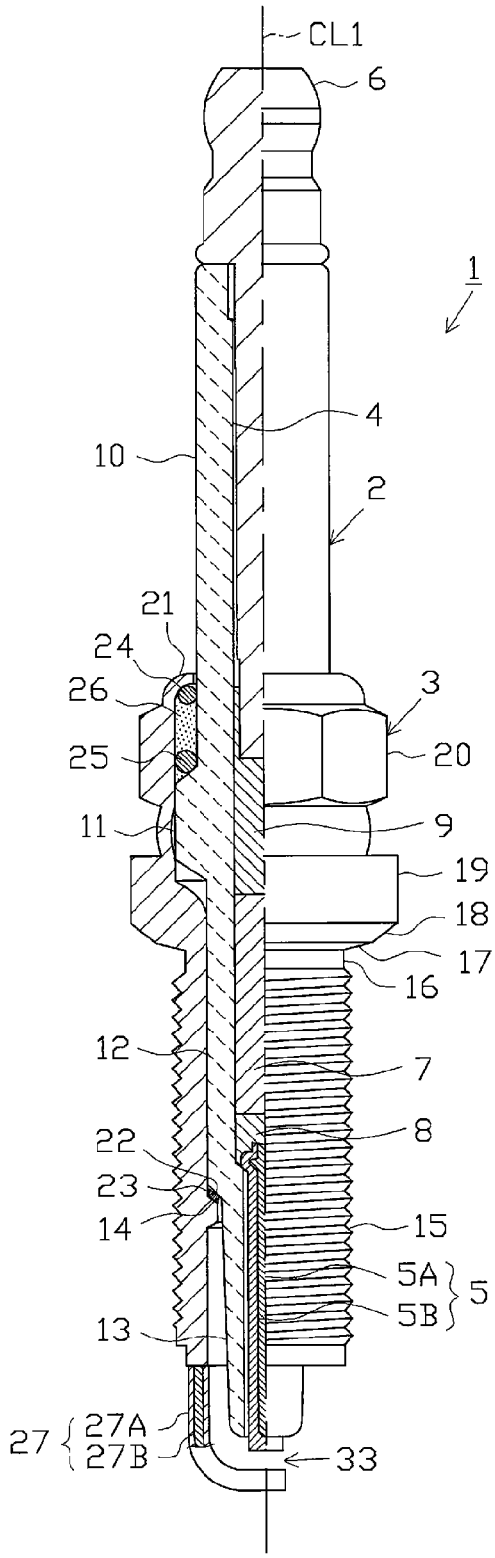
FIG. 1 is a partially sectioned front view showing the structure of a spark plug.

A first embodiment of the present invention will now be described with reference to the drawings. FIG. 1 is a partially sectioned front view showing a spark plug 1. Notably, in FIG. 1, the spark plug 1 is depicted in such a manner that the direction of an axis CL1 of the spark plug 1 coincides with the vertical direction in FIG. 1. Further, in the following description, the lower side of FIG. 1 will be referred to as the front end side of the spark plug 1, and the upper side of FIG. 1 will be referred to as the rear end side of the spark plug 1.

The spark plug 1 is comprised of a tubular insulator 2, and a tubular metallic shell 3 which holds the insulator 2.

As well known, the insulator 2 is formed from alumina or the like through firing. The insulator 2 includes a rear-end-side trunk portion 10 formed on the rear end side; a larger diameter portion 11 projecting radially outward on the front end side of the rear-end-side trunk portion 10; an intermediate trunk portion 12 formed on the front end side of the larger diameter portion 11 and having a diameter smaller than that of the larger diameter portion 11; and a leg portion 13 formed on the front end side of the intermediate trunk portion 12 and having a diameter smaller than that of the intermediate trunk portion 12. The larger diameter portion 11, the intermediate trunk portion 12, and the greater part of the leg portion 13 of the insulator 2 are all accommodated within the metallic shell 3. A tapered step portion 14 is formed at a connection portion between the intermediate trunk portion 12 and the leg portion 13. The insulator 2 is engaged with the metallic shell 3 at the step portion 14.

Furthermore, the insulator 2 has an axial hole 4 which extends through the insulator 2 along the axis CL1. A center electrode 5 is fixedly inserted into a front end portion of the axial hole 4. The center electrode 5 is composed of an inner layer 5A formed of copper or a copper alloy, and an outer layer 5B formed of a nickel alloy whose predominant component is nickel (Ni). The center electrode 5 assumes a rod-like shape (cylindrical columnar shape) as a whole. A flat front end surface of the center electrode 5 projects from the front end of the insulator 2.

A terminal electrode 6 is fixedly inserted into a rear end portion of the axial whole 4 such that the terminal electrode 6 projects from the rear end of the insulator 2.

Furthermore, a cylindrical columnar resistor 7 is disposed in the axial hole 4 between the center electrode 5 and the terminal electrode 6. Opposite ends of the resistor 7 are electrically connected to the center electrode 5 and the terminal electrode 6, respectively, via electrically conductive glass seal layers 8 and 9.

The metallic shell 3 is formed of metal such as low carbon steel and has a tubular shape. The metallic shell has a thread portion 15, a thread neck portion 16, a connection portion 17, a seat portion 18, and a larger diameter portion 19, which are formed on the outer circumferential surface of the metallic shell 3 in this sequence from the front end side toward the rear end side along the axis CL1.

When the spark plug 1 is attached to a combustion apparatus such as an internal combustion engine, the thread portion 15 is screwed into an attachment hole of the combustion apparatus. In the present embodiment, the thread portion 15 has a relatively small thread diameter (e.g., 12.0 mm or less). The thread neck portion 16 is formed continuously with the rear end of the thread portion 15, and assumes the form of a cylindrical column having a diameter smaller than the thread diameter of the thread portion 15.

The seat portion 18 is tapered so that its diameter increases toward the rear end side with respect to the direction of the axis CL1, and comes into surface contact with a seat surface of the combustion apparatus when the spark plug 1 is attached to the combustion apparatus. The connection portion 17 is configured to connect the front end of the seat portion 18 and the rear end of the thread neck portion 16, and is tapered as in the case of the seat portion 18. However, as viewed on a cross-section including the axis CL1, the angle between the axis CL1 and the outline of the connection portion 17 is made greater than the angle between the axis CL1 and the outline of the seat portion 18. Therefore, even when the spark plug 1 is attached to the combustion apparatus, the connection portion 17 does not come into contact with the combustion apparatus.

The larger diameter portion 19 extends rearward from the rear end of the seat portion 18 and assumes the form of a flange swelling radially outward. A tool engagement portion 20 is provided on the rear end side of the larger diameter portion 19. The tool engagement portion 20 has a hexagonal cross-section. The tool engagement portion 20 is designed and dimensioned to engage a tool, such as a wrench, when the spark plug 1 is attached to the combustion apparatus. In addition, a crimped portion 21 for holding the insulator 2 is provided at the rear end of the metallic shell 3.

Furthermore, a tapered step portion 22 with which the insulator 2 is engaged is provided on the inner circumferential surface of the metallic shell 3. The insulator 2 is inserted into the metallic shell 3 from its rear end side toward the front end side. In a state in which the step portion 14 of the insulator 2 is engaged with the step portion 22 of the metallic shell 3, a rear-end-side opening portion of the metallic shell 3 is crimped radially inward; i.e., the above-mentioned crimped portion 21 is formed, whereby the insulator 2 is fixed. Notably, an annular plate packing 23 is interposed between the step portions 14 and 22 of the insulator 2 and the metallic shell 3. Thus, the airtightness of a combustion chamber is secured, whereby an air-fuel mixture which may enter the clearance between the inner circumferential surface of the metallic shell 3 and the leg portion 13 of the insulator 2 from the interior of the combustion chamber is prevented from leaking to the outside.

Moreover, in order to render the sealing by the crimping more perfect, on the rear end side of the metallic shell 3, annular ring members 24 and 25 are interposed between the metallic shell 3 and the insulator 2, and powder of talc 26 is charged into the space between the ring members 24 and 25. That is, the metallic shell 3 holds the insulator 2 via the plate packing 23, the ring members 24 and 25, and the talc 26.

A ground electrode 27 which is bent at an approximate center portion thereof is joined to a front end portion of the metallic shell 3 so that a distal end portion of the ground electrode 27 faces a front end portion of the center electrode 5. The ground electrode 27 has a double layer structure composed of an outer layer 27A and an inner layer 27B. The outer layer 27A is formed of a nickel alloy. The inner layer 27B is formed of a copper alloy, pure copper or pure nickel, which are higher in heat conductivity than the above-mentioned nickel alloy. A spark discharge gap 33 is formed between the front end portion of the center electrode 5 and the distal end portion of the ground electrode 27. Therefore, at the spark discharge gap 33, spark discharge occurs along a direction approximately parallel to the axis CL1.

Next, a method of manufacturing the spark plug 1 configured as described above will be described.

First, the insulator 2 is formed. For example, material granules for molding are prepared from material powder containing alumina (predominant component), binder, etc. A cylindrical compact is obtained by performing rubber press molding while using the material granules. Grinding is performed on the obtained compact for trimming. The trimmed compact is fired, whereby the insulator 2 is obtained.

Further, separately from the insulator 2, the center electrode 5 is manufactured. That is, a nickel alloy, in which a copper alloy or the like is placed at a center portion thereof in order to improve heat radiation performance, is forged so as to fabricate the center electrode 5.

The insulator 2 and the center electrode 5 (which have been fabricated as described above), the resistor 7, and the terminal electrode 6 are fixed together and sealed by means of the glass seal layers 8 and 9. In general, the glass seal layers 8 and 9 are formed as follows. A powder mixture, prepared through mixing borosilicate glass powder and metal powder, is charged, i.e., inserted, into the axial hole 4 of the insulator 2 so that the resistor 7 is sandwiched by the powder mixture, and the terminal electrode 6 is then inserted and pressed from the rear side. In this state, the powder mixture is baked by being heated within a firing furnace. Notably, at that time, a glaze layer may be simultaneously formed on the surface of the rear-end-side trunk portion 10 of the insulator 2 through firing. Alternatively, the glaze layer may be formed in advance.

The metallic shell 3 is separately fabricated. That is, a cold forging operation is performed on a cylindrical columnar metal material (e.g., iron material or stainless steel material such as S17C or S25C) so as to form a through hole therein and impart a rough shape to the metal material. Subsequently, cutting operation is performed on the metal material so as to impart a predetermined outer shape to the metal material. Thus, a metallic shell intermediate is obtained.

Subsequently, a straight-bar-shaped ground electrode 27 formed of a Ni alloy or the like is resistance welded to a front end surface of the metallic shell intermediate. Since a so-called "slag" is produced as a result of the welding, after the "slag" is removed, the thread portion 15 is formed on the metallic shell intermediate at a predetermined position through form rolling. As a result, the metallic shell 3 having the ground electrode joined thereto is obtained. Further, zinc plating or nickel plating may be performed on the metallic shell 3 with the ground electrode 27 welded thereto. Furthermore, in order to increase corrosion resistance, the surface of the metallic shell 3 may be treated with chromate.

Figure 2:
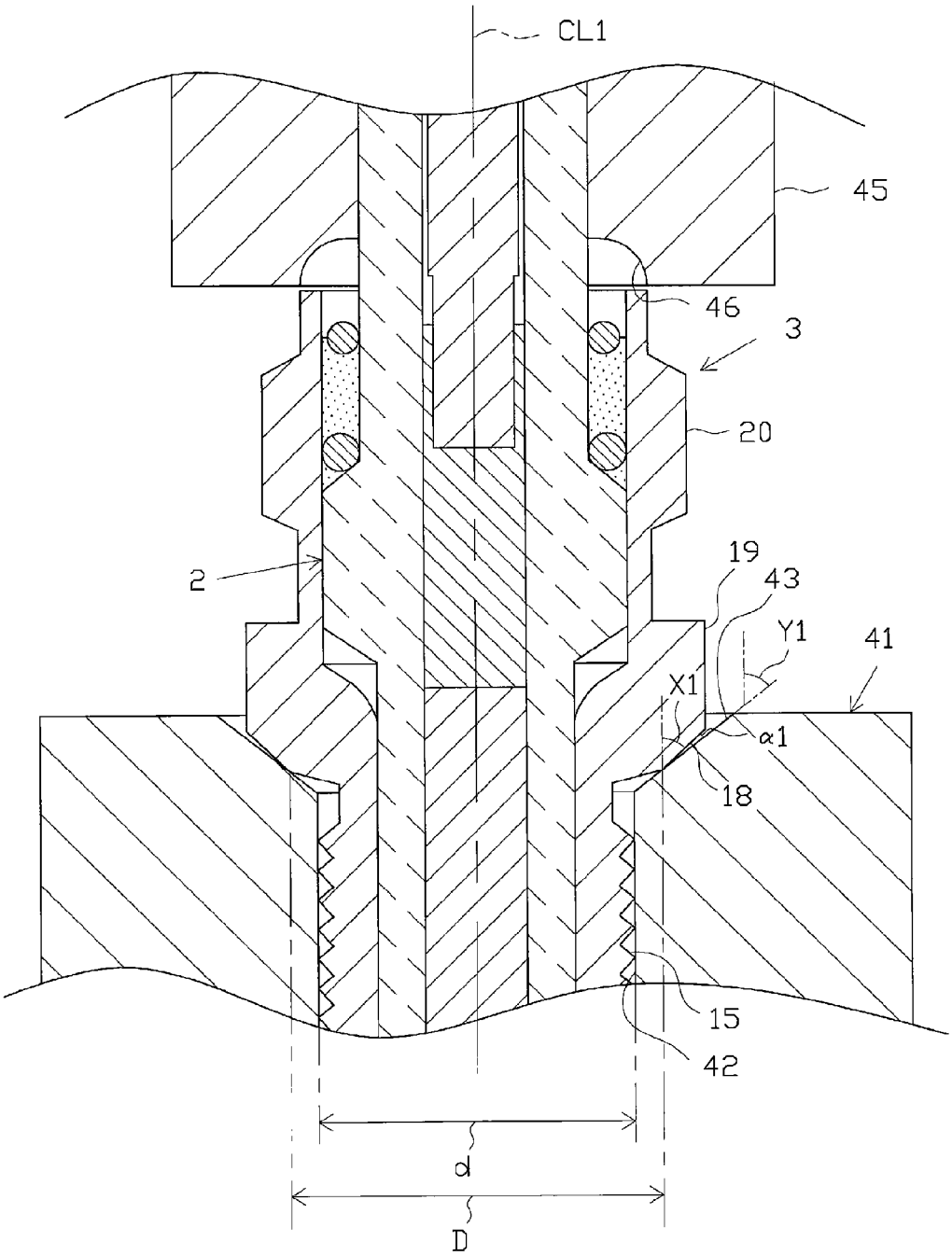
FIG. 2 is an enlarged partial sectional view showing the configurations of a seat portion and a taper portion in a fixing step in a first embodiment.

Notably, the obtained metallic shell 3 is such that, as viewed on a cross-section including the axis CL1 (FIG. 2), an angle X1 defined between the outline, i.e., surface, of the seat portion 18 and the axis CL1 is smaller, by 0.5° to 9.0° inclusive, than an angle defined between the seat surface of the combustion apparatus to which the spark plug is attached and a center axis of an attachment hole of the combustion apparatus. In addition, the outer diameter D (mm) of the front end of the seat portion 18 is made greater than the thread diameter of the thread portion 15. Moreover, at least the seat portion 18 of the metallic shell 3 has a Vickers hardness of 150 Hv to 350 Hv inclusive.

After that, in a fixing step, the insulator 2 carrying the center electrode 5 and the terminal electrode 6, and the metallic shell 3 having the ground electrode 27 are fixed together.

In the fixing step, a front end portion of the metallic shell 3 with the insulator 2 inserted thereinto is inserted into a tubular receiving die 41, whereby the metallic shell 3 is held by the receiving die 41. Notably, the receiving die 41 includes an insertion hole 42 into which the thread portion 15 can be inserted, and a taper portion 43 adjacently surrounding the opening of the insertion hole 42. The taper portion 43 is formed such that, as viewed on a cross-section including the axis CL1, an angle Y1 between the outline, i.e., surface, of the taper portion 43 and the axis CL1 becomes equal to an angle between the seat surface of the combustion apparatus and the center axis of the attachment hole of the combustion apparatus (e.g., 63°). Accordingly, in the fixing step, the metallic shell 3 and the insulator 2 are fixed together in a state in which, as viewed on a cross-section including the axis CL1, an angle $\alpha$1 between the taper portion 43 and the seat portion 18 is set to 0.5° to 9.0° inclusive (e.g., 1.0° to 9.0° inclusive). At the beginning of the fixing step (a stage before a load is applied to the metallic shell 3 by use of a pressing die 45 to be described later), only a front end portion of the seat portion 18 comes into a line contact with the taper portion 43 of the receiving die 41 in an annular region.

In addition, the outer diameter D (mm) of the front end of the seat portion 18 of the metallic shell 3 is made greater than the inner diameter d (mm) of the boundary portion between the insertion hole 42 and the taper portion 43 by 0.1 mm to 0.8 mm inclusive (e.g., 0.3 mm to 0.8 mm inclusive). Accordingly, a front end portion (corner portion) of the seat portion 18 comes into contact with the flat taper portion 43, rather than the boundary portion (corner portion) between the insertion hole 42 and the taper portion 43.

The receiving die 41 is formed of hard steel such as hardened steel, and the hardness of at least the taper portion 43 is set to 50 HRC to 66 HRC inclusive in Rockwell hardness (513 Hv to 865 Hv inclusive in Vickers hardness). That is, at least a portion of the receiving die 41, namely, that portion which comes into contact with the seat portion 18, is greater in hardness than the seat portion 18.

Referring back to the description of the manufacturing method, after the metallic shell 3 is held by the receiving die 41, the pressing die 45 is attached from the upper side of the metallic shell 3. The pressing die 45 assumes a tubular shape, and has a curved surface portion 46 which is formed on the inner circumferential surface of an opening portion at the front end thereof and whose shape corresponds to the shape of the crimped portion 21.

Figure 3:
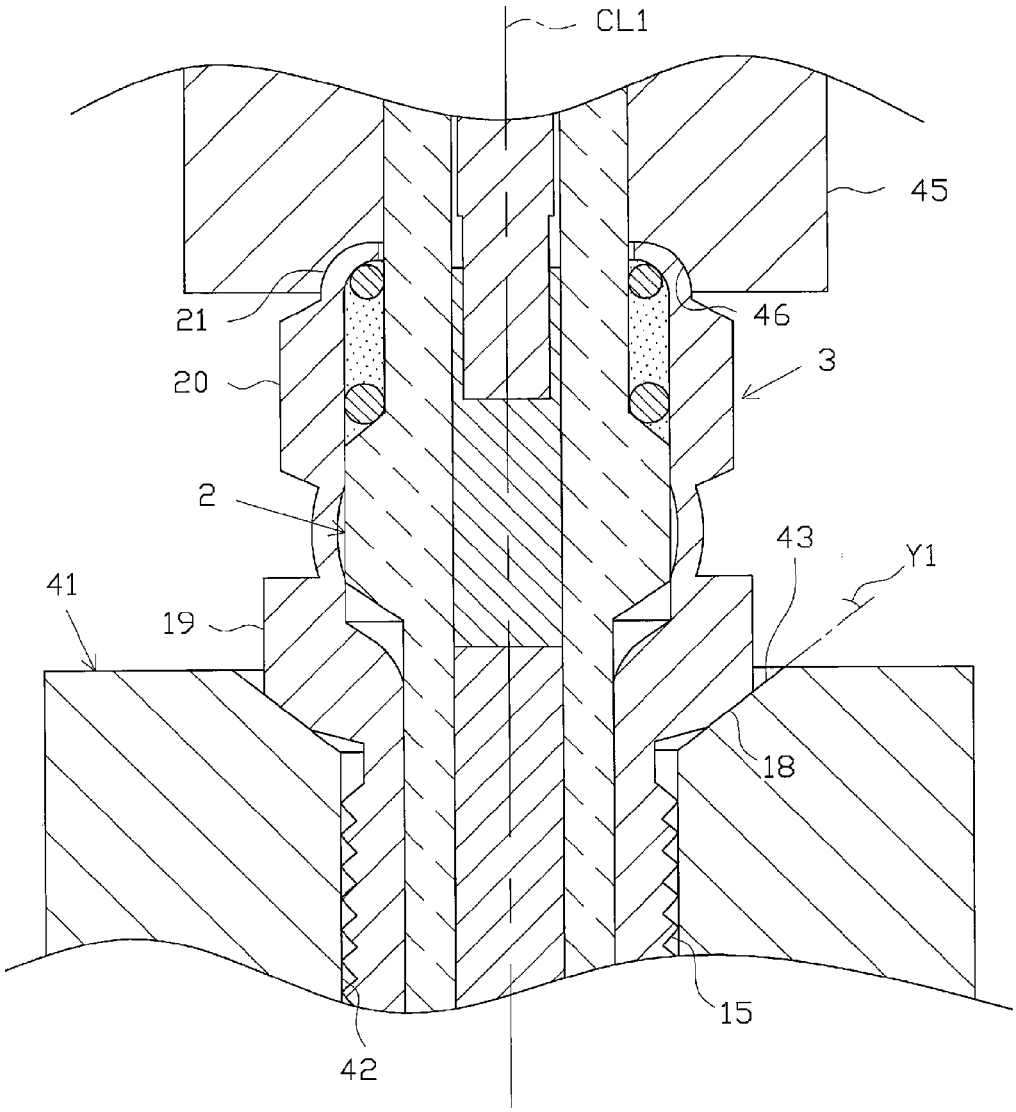
FIG. 3 is an enlarged partial sectional view showing the configurations of a metallic shell, etc. after application of a load from a pressing die in the fixing step.

Next, in a state in which the metallic shell 3 is held between the receiving die 41 and the pressing die 45, the pressing die 45 is relatively moved toward the metallic shell 3, to thereby apply a predetermined load (e.g., 30 kN to 50 kN inclusive) to the metallic shell 3 along the direction of the axis CL1. With this operation, as shown in FIG. 3, the seat portion 18 is pressed against the taper portion 43 of the receiving die 41 and deforms so that, as viewed on a cross-section including the axis CL1, the angle between the seat portion 18 and the axis CL1 becomes equal to the angle Y1 between the taper portion 43 and the axis CL1. As a result, the seat portion 18 is configured such that it can come into surface contact with the seat surface of the combustion apparatus. Furthermore, as a result of the rear-end-side opening portion of the metallic shell 3 being bent radially inward, the above-mentioned crimped portion 21 is formed, whereby the insulator 2 and the metallic shell 3 are fixed together.

Notably, upon application of load from the pressing die 45 to the metallic shell 3, a cylindrical tubular portion thereof located between the larger diameter portion 19 and the tool engagement portion 20 and having a relatively small wall thickness deforms and curves radially outward. Thus, an axial force along the axis CL1 from the metallic shell 3 acts onto the insulator 2. As a result, the insulator 2 and the metallic shell 3 are fixed together more reliably.

After the metallic shell 3 and the insulator 2 are fixed together, the ground electrode 27 is bent toward the center electrode 5, and the size of the spark discharge gap 33 between the front end portion of the center electrode 5 and the distal end portion of the ground electrode 27 is adjusted, whereby the above-described spark plug 1 is obtained.

As described above, according to the above-described embodiment, in the fixing step, a pressing force is applied to the metallic shell 3 in a state in which the angle $\alpha$1 between the taper portion 43 and the seat portion 18, as viewed in a cross-section including the axis CL1, is made equal to or greater than 0.5°. That is, at the beginning of the fixing step, the seat portion 18 of the metallic shell 3 does not come into surface contact with the taper portion 43 of the receiving die 41, but comes into line contact therewith in an annular region. Accordingly, when a pressing force along the axis CL1 is applied from the pressing die 45 to the metallic shell 3, the greater part of the applied force is used to press the seat portion 18 against the taper portion 43 and deform the seat portion 18. Thus, radially inward deformation of the material of the seat portion 18 can be prevented more reliably, and biting of the metallic shell 3 against the receiving die 41 can be prevented more reliably. As a result, after the fixing step, the metallic shell 3 can be easily removed from the receiving die 41, whereby productivity can be improved.

Furthermore, since biting of the metallic shell 3 against the receiving die 41 is prevented, formation of a mark on the seat portion 18 can be prevented more reliably. That is, according to the above-described embodiment, in addition to productivity, yield can be improved as well.

In addition, the outer diameter D of the front end of the seat portion 18 is made greater than the inner diameter d of the boundary portion between the insertion hole 42 and the taper portion 43 by 0.1 mm or more. Accordingly, in the fixing step, a sufficiently large clearance can be secured between the insertion hole 42 and a portion of the seat portion 18, which portion comes into contact with the taper portion 43 and deforms. Therefore, even in the case where the material of the seat portion 18 deforms radially inward upon application of a load onto the metallic shell 3 from the pressing die 45, the material of the seat portion 18 is more reliably prevented from reaching the insertion hole 42. As a result, biting of the metallic shell 3 against the receiving die 41 can be prevented more reliably, whereby productivity and yield can be improved further.

Additionally, the diameter difference between the outer diameter D of the front end of the seat portion 18 and the inner diameter d of the boundary portion between the insertion hole 42 and the taper portion 43 is set to 0.8 mm or less. Therefore, the surface of the seat portion 18 can be secured sufficiently, and deterioration of the airtightness of the manufactured spark plug 1 can be prevented more reliably.

Furthermore, in the fixing step, a pressing force is applied to the metallic shell 3 in a state in which the angle $\alpha$1 that is defined between the taper portion 43 and the seat portion 18, as viewed in a cross-section including the axis CL1, is made equal to or less than 9.0°. Therefore, the seat portion 18 can be more reliably deformed into a shape corresponding to that of the taper portion 43. Accordingly, a contact area of the seat portion 18 against the combustion apparatus can be secured more sufficiently, whereby airtightness can be improved further.

Second Embodiment

A second embodiment of the present invention shall be described with reference to the drawings. In the following description, the point of difference between the second embodiment and the first embodiment will mainly be described.

Figure 4:
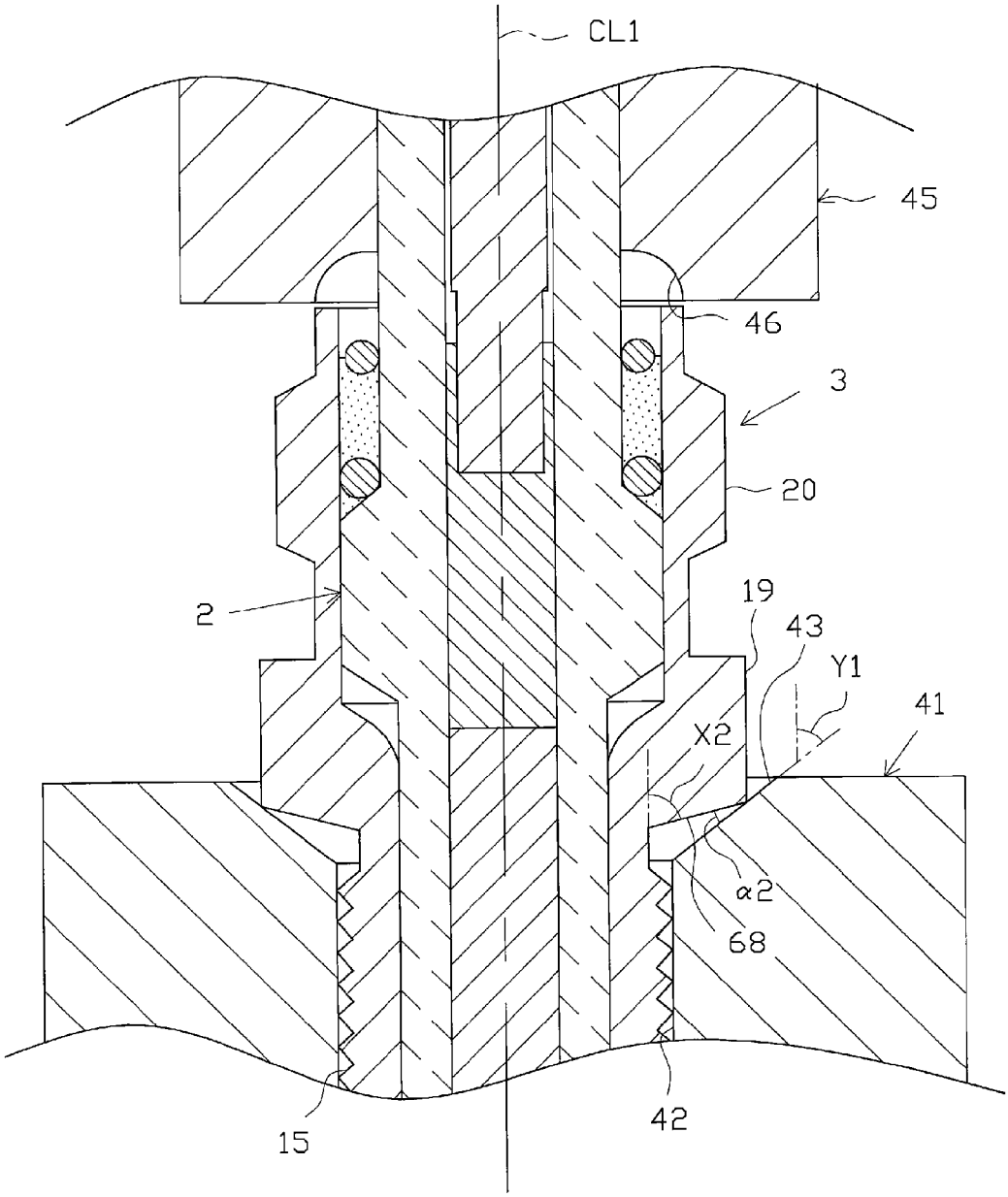
FIG. 4 is an enlarged partial sectional view showing the configurations of the seat portion and the taper portion in the fixing step in a second embodiment.

In the second embodiment, as shown in FIG. 4, as viewed on a cross-section including the axis CL1, an angle X2 that is defined between the axis CL1 and a seat portion 68 differs from the angle X1 that is defined between the axis CL1 and the seat portion 18 in the first embodiment. That is, in the second embodiment, as viewed on a cross-section including the axis CL1, the angle X2 is greater than the angle Y1 between the axis CL1 and the taper portion 43 by 0.5° or more (e.g., 1.0° to 9.0° inclusive). Accordingly, in the second embodiment, as viewed on a cross-section including the axis CL1, an angle $\alpha$2 between the taper portion 43 and the seat portion 68 is set to 0.5° or greater, and, at the beginning of the fixing step, only a rear end portion of the seat portion 68 comes into line contact with the taper portion 43 of the receiving die 41 in an annular region. When a load is applied from the pressing die 45 to the metallic shell 3, the crimped portion 21 is formed, and a rear-end-side portion of the seat portion 68 is pressed against the taper portion 43, and deforms. As a result, the rear-end-side portion of the seat portion 68 serves as the seat portion 18, and a front-end-side portion of the seat portion 68 serves as the connection portion 17, whereby the above-described metallic shell 3 is obtained.

According to the present second embodiment, basically, an action and effects similar to those of the first embodiment can be attained.

Moreover, according to the second embodiment, a portion of the seat portion 68, which portion comes into contact with the taper portion 43, is separated further from the insertion hole 42. Therefore, even in the case where the material of the seat portion 68 deforms radially inward upon application of a load onto the metallic shell 3 from the pressing die 45, the material of the seat portion 68 hardly reaches the insertion hole 42. As a result, biting of the metallic shell 3 against the receiving die 41 can be prevented more reliably, whereby productivity and yield can be improved further.

Next, in order to confirm the actions and effects achieved by the above-described embodiments, a biting occurrence evaluation test was performed. In the biting occurrence evaluation test, there were manufactured samples of the metallic shell in which the thread diameter of the thread portion was set to M10 (10.0 mm), M12 (12.0 mm), or M14 (14.0 mm), the outer diameter of the front end of the seat portion was set to 11.9 mm or 12.2 mm, and the angle X between the axis and the seat portion as viewed on a cross-section including the axis was changed in various manners. 100 samples were manufactured for each value of the angle X, and were subjected to the biting occurrence evaluation test. The outline of the biting occurrence evaluation test will be described. That is, for the samples, there was prepared a receiving die having a fixed angle (63°) between the axis and the taper portion as viewed on a cross-section including the axis. The above-described fixing step was performed for each sample by use of the receiving die. Subsequently, of 100 samples having the same angle X, the number of samples having suffered biting of the metallic shell against the receiving die was counted, and the rate (percentage) of the samples having suffered biting (biting occurrence rate) was calculated. Notably, the receiving die was configured such that the boundary portion between the taper portion and the insertion portion had an inner diameter of 11.9 mm. Further, a load of 39 kN was applied from the pressing die to each sample along the axis.

Moreover, the seat portion of each spark plug obtained in the above-described test was observed, and an area of a portion (a portion to come into contact with a seat surface of a combustion apparatus) having deformed to have the same angle (63°) as the taper portion of the receiving die was measured. Each sample in which the area of that portion was sufficiently large was determined to sufficiently secure airtightness upon attachment to the combustion apparatus, and was evaluated "Good." Meanwhile, a sample in which the area of that portion was slightly insufficient was determined to have impaired airtightness, and was evaluated "Fair."

Figure 5:
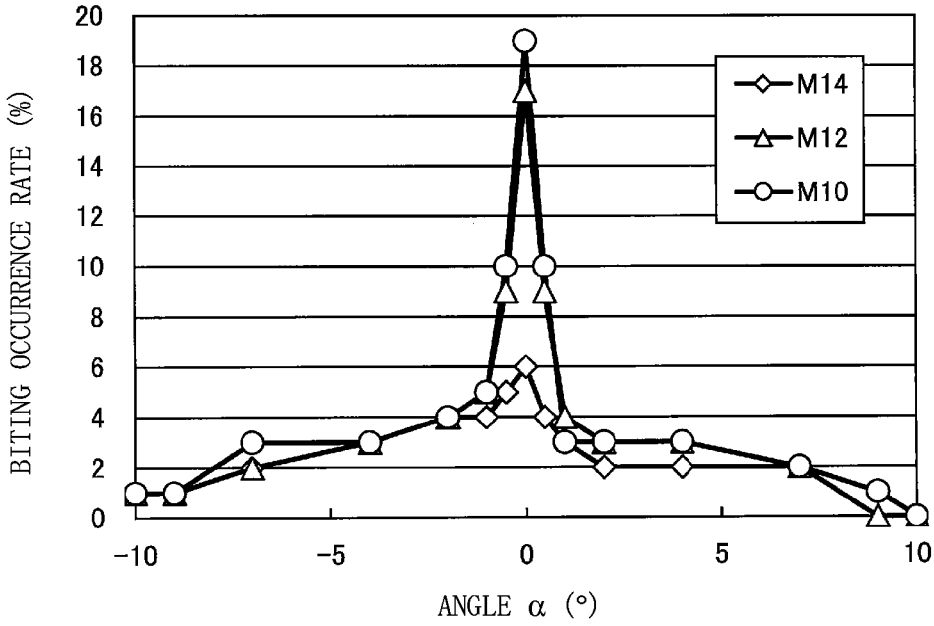
FIG. 5 is a graph showing test results of a biting occurrence evaluation test performed for samples prepared by variously changing the angle between the seat portion and the taper portion, with the diameter difference between the outer diameter of the front end of the seat portion and the inner diameter of a boundary portion between the taper portion and an insertion hole being set to 0.0 mm.
Figure 6:
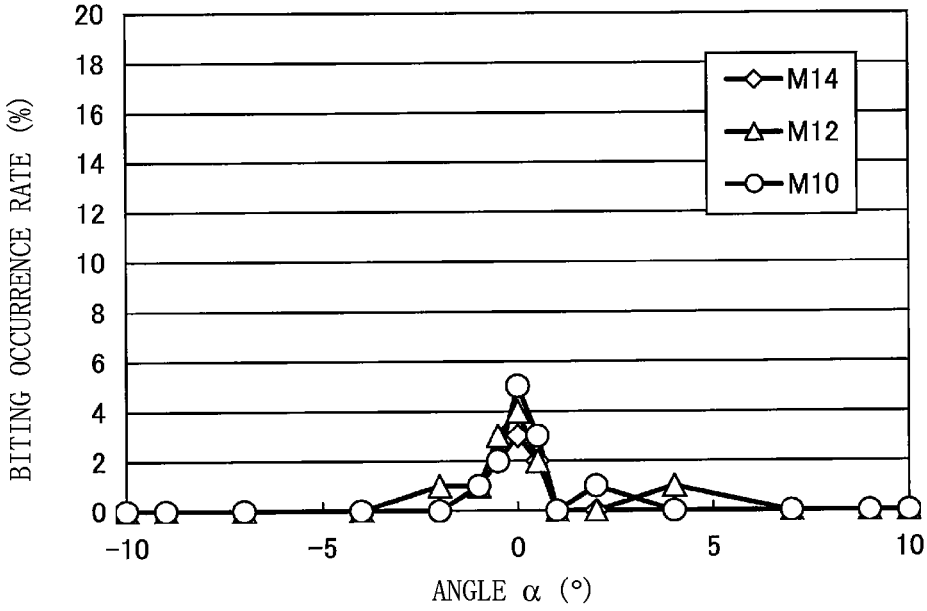
FIG. 6 is a graph showing test results of a biting occurrence evaluation test performed for samples prepared by variously changing the angle between the seat portion and the taper portion, with the diameter difference between the outer diameter of the front end of the seat portion and the inner diameter of the boundary portion between the taper portion and the insertion hole being set to 0.3 mm.

Tables 1 and 2 show the test results for the samples in which the outer diameter of the front end of the seat portion was set to 11.9 mm (that is, the case where the diameter difference between the outer diameter of the front end of the seat portion and the inner diameter of the boundary portion between the taper portion and the insertion portion was set to 0.0 mm). Tables 3 and 4 show the test results for the samples in which the outer diameter of the front end of the seat portion was set to 12.2 mm (that is, the case where the diameter difference between the outer diameter of the front end of the seat portion and the inner diameter of the boundary portion between the taper portion and the insertion portion was set to 0.3 mm). FIG. 5 is a graph showing the results of the biting occurrence evaluation test performed on samples in which the outer diameter of the front end of the seat portion was set to 11.9 mm, and FIG. 6 is a graph showing the results of the biting occurrence evaluation test performed on samples in which the outer diameter of the front end of the seat portion was set to 12.2 mm. Notably, the "angle α" in Tables 1 to 4 and FIGS. 5 and 6 refers to an angle obtained by subtracting the angle (63°) between the axis and the taper portion from the angle X between the axis and the seat portion as viewed on a cross-section including the axis. Accordingly, in the case where the angle α assumed a positive value, the angle X was larger than the angle between the axis and the taper portion, and at the beginning of the fixing step, a rear end portion of the seat portion came into contact with the taper portion. Meanwhile, in the case where the angle α assumed a negative value, the angle X was smaller than the angle between the axis and the taper portion, and at the beginning of the fixing step, a front end portion of the seat portion came into contact with the taper portion.

TABLE 1

| Thread diameter | | Seat portion angle X (°) | | | | | | | |
|---|---|---|---|---|---|---|---|---|---|
| | | 53 | 54 | 56 | 59 | 61 | 62 | 62.5 | 63 |
| | | Angle α (°) | | | | | | | |
| | | −10 | −9 | −7 | −4 | −2 | −1 | −0.5 | 0 |
| M14 | Biting occurrence rate (%) | 1 | 1 | 2 | 3 | 4 | 4 | 5 | 6 |
| M12 | Biting occurrence rate (%) | 1 | 1 | 2 | 3 | 4 | 5 | 9 | 17 |
| M10 | Biting occurrence rate (%) | 1 | 1 | 3 | 3 | 4 | 5 | 10 | 19 |
| M10-M14 | Airtightness evaluation | Fair | Good | Good | Good | Good | Good | Good | Good |

TABLE 2

| Thread diameter | | Seat portion angle X (°) | | | | | | | |
|---|---|---|---|---|---|---|---|---|---|
| | | 63 | 63.5 | 64 | 65 | 67 | 70 | 72 | 73 |
| | | Angle α (°) | | | | | | | |
| | | 0 | 0.5 | 1 | 2 | 4 | 7 | 9 | 10 |
| M14 | Biting occurrence rate (%) | 6 | 4 | 3 | 2 | 2 | 2 | 1 | 0 |
| M12 | Biting occurrence rate (%) | 17 | 9 | 4 | 3 | 3 | 2 | 0 | 0 |
| M10 | Biting occurrence rate (%) | 19 | 10 | 3 | 3 | 3 | 2 | 1 | 0 |
| M10-M14 | Airtightness evaluation | Good | Good | Good | Good | Good | Good | Good | Fair |

TABLE 3

| Thread diameter | | Seat portion angle X (°) 53 | 54 | 56 | 59 | 61 | 62 | 62.5 | 63 |
|---|---|---|---|---|---|---|---|---|---|
| | | Angle α (°) −10 | −9 | −7 | −4 | −2 | −1 | −0.5 | 0 |
| M14 | Biting occurrence rate (%) | 0 | 0 | 0 | 0 | 0 | 1 | 2 | 3 |
| M12 | Biting occurrence rate (%) | 0 | 0 | 0 | 0 | 1 | 1 | 3 | 4 |
| M10 | Biting occurrence rate (%) | 0 | 0 | 0 | 0 | 0 | 1 | 2 | 5 |
| M10-M14 | Airtightness evaluation | Fair | Good | Good | Good | Good | Good | Good | Good |

TABLE 4

| Thread diameter | | Seat portion angle X (°) 63 | 63.5 | 64 | 65 | 67 | 70 | 72 | 73 |
|---|---|---|---|---|---|---|---|---|---|
| | | Angle α (°) 0 | 0.5 | 1 | 2 | 4 | 7 | 9 | 10 |
| M14 | Biting occurrence rate (%) | 3 | 2 | 0 | 0 | 0 | 0 | 0 | 0 |
| M12 | Biting occurrence rate (%) | 4 | 2 | 0 | 0 | 1 | 0 | 0 | 0 |
| M10 | Biting occurrence rate (%) | 5 | 3 | 0 | 1 | 0 | 0 | 0 | 0 |
| M10-M14 | Airtightness evaluation | Good | Good | Good | Good | Good | Good | Good | Fair |

As shown in Tables 1 to 4 and FIGS. 5 and 6, it was found that biting of the metallic shell against the receiving die is very likely to occur in the samples in which the angle α between the seat portion and the taper portion as viewed on a cross-section including the axis is set to 0°. Presumably, this phenomenon occurred for the following reason. Since the seat portion of each sample was in surface contact with the taper portion, when a load was applied to the sample along the axis thereof, the material of the seat portion easily deformed radially inward along the taper portion of the receiving die.

In contrast, it was found that, in the samples in which the angle α was set to 0.5° or greater in absolute value, biting of the metallic shell against the receiving die can be suppressed effectively. Presumably, this phenomenon occurred for the following reason. When a load was applied to the sample along the axis thereof, the greater part of the applied force was used to press the seat portion against the taper portion, to thereby compressively deform the seat portion, and, as a result, radially inward deformation of the material of the seat portion was suppressed effectively.

In particular, it was confirmed that biting of the metallic shell against the receiving die can be suppressed to a greater degree by means of increasing the absolute value of the angle α. Accordingly, from the viewpoint of further suppressing the biting, setting the angle α to 1.0° or greater in absolute value is more preferred, and setting the angle α to 2.0° or greater in absolute value is further more desirable.

However, it was found that, in the case where the angle α is set to 10° in absolute value, although the occurrence of biting can be suppressed, the seat portion encounters difficulty in deforming along the taper portion, whereby the area of the seat portion becomes insufficient to some degree, and, and, as a result, airtightness may be impaired. Accordingly, from the viewpoint of securing excellent airtightness, setting the angle α to 9.0° or less in absolute value is preferred.

Moreover, it was found that, in the samples in which the diameter difference between the outer diameter of the front end of the seat portion and the inner diameter of the boundary portion between the taper portion and the insertion portion is set to 0.3 mm, occurrence of biting can be suppressed more reliably as compared with the case of the samples in which the diameter difference is set to 0.0 mm.

Next, in order to check the influence of the diameter difference on the action and effects, there were prepared samples of the metallic shell in which the diameter difference (D−d) between the outer diameter D of the front end of the seat portion and the inner diameter d of the boundary portion between the taper portion and the insertion portion was changed in various manners by means of changing the outer diameter D of the front end of the seat portion in various manners. 100 samples were manufactured for each value of the diameter difference (D−d), and each sample was subjected to the above-mentioned biting occurrence evaluation test. Notably, in each sample, the angle X between the axis and the seat portion as measured on a cross-section including the axis was set to 63° (angle α=0°) or 64° (angle α=1°). Furthermore, the inner diameter d of the boundary portion between the taper portion and the insertion portion was set to 11.9 mm.

Figure 7:
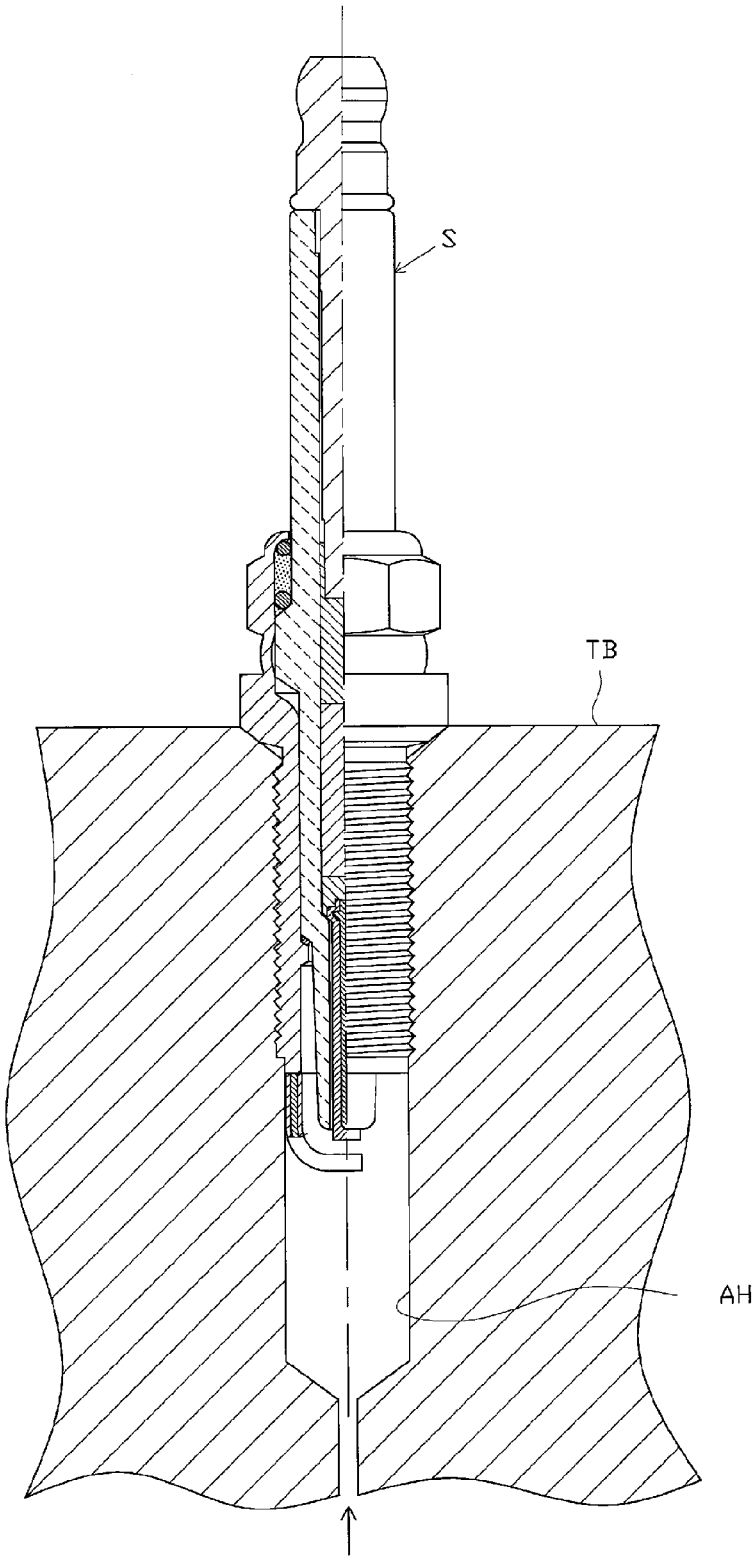
FIG. 7 is a partially sectioned front schematic view used for describing a method of performing an airtightness evaluation test.

Moreover, an airtightness evaluation test was also performed for samples of the spark plug obtained in the above-described text. Notably, the airtightness evaluation test was performed in accordance with JIS B8031. The outline of the airtightness evaluation test will be described below. That is, as shown in FIG. 7, a sample S was attached to an attachment hole AH of a test bench TB formed of aluminum and simulating an engine head, and was held at 150° C. for 30 minutes. After that, in a state in which an air pressure of 1.5 MPa was applied from an opening of the attachment hole AH toward the front end of the sample S, an amount (per minute) of air leaked from the clearance between the seat portion and the test bench TB was measured. A sample whose air leakage amount was 5 ml/min or less was determined to be excellent in airtightness, and evaluated "Good," and a sample whose air leakage amount was in excess of 5 ml/min was determined to be rather poor in airtightness, and evaluated "Fair."

Figure 8:
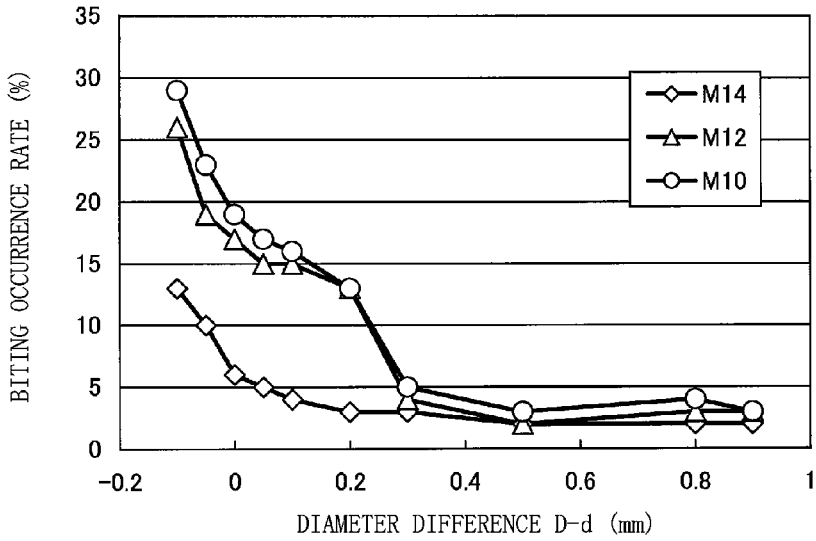
FIG. 8 is a graph showing test results of a biting occurrence evaluation test performed for samples prepared by variously changing the diameter difference between the outer diameter of the front end of the seat portion and the inner diameter of the boundary portion between the taper portion and the insertion hole, with the angle between the axis and the seat portion being set to 63°.
Figure 9:
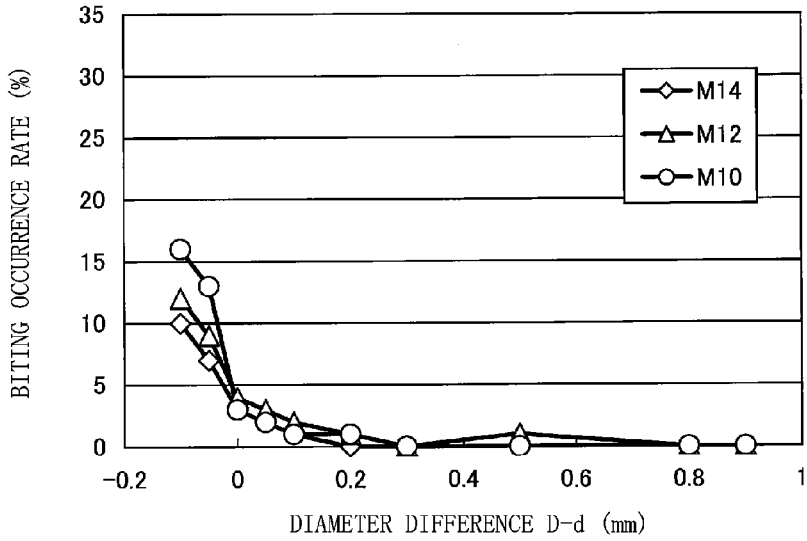
FIG. 9 is a graph showing test results of a biting occurrence evaluation test performed for samples prepared by variously changing the diameter difference between the outer diameter of the front end of the seat portion and the inner diameter of the boundary portion between the taper portion and the insertion hole, with the angle between the axis and the seat portion being set to 64°.

Table 5 shows the test results for the samples in which the angle X was set to 63° (the angle α was set to 0.0°). Table 6 shows the test results for the samples in which the angle X was set to 64° (the angle α was set to 1°). FIG. 8 is a graph showing the results of the biting occurrence evaluation test performed for the samples in which the angle X was set to 63°. FIG. 9 is a graph showing the results of the biting occurrence evaluation test performed for the samples in which the angle X was set to 64°.

Presumably, this phenomenon occurred for the following reason. As a result of provision of a sufficiently large diameter difference of 0.1 mm or greater, a sufficiently large clearance was formed between the insertion hole and a portion of the seat portion which came into contact with the taper portion and deformed. As a result, even in the case where the material of the seat portion deformed radially inward upon application of a load from the pressing die, the material of the seat portion was less likely to reach the insertion hole.

In particular, it was found that, by means of setting the diameter difference (D−d) to 0.3 mm or greater, biting of the metallic shell against the receiving die can be suppressed quite effectively.

Meanwhile, it was found that the samples having a diameter difference (D−d) of 0.9 mm are rather poor in airtightness, although they can suppress occurrence of biting. Presumably, this phenomenon occurred for the following reason. As the diameter difference (D−d) was increased, the area of the seat portion decreased, and, as a result, the contact area between the seat portion and the test bench TB decreased.

When the results of the above-described tests are considered comprehensively, it is more preferred that the angle that is defined between the taper portion and the seat portion as viewed on a cross-section including the axis is set to 0.5° or greater in order to suppress biting of the metallic shell against the receiving die. Furthermore, from the viewpoint of further suppressing biting of the metallic shell against the receiving die, it is more preferred that the angle that is defined between the taper portion and the seat portion is set to 1.0° or greater,

TABLE 5

| Thread dia. | | Front end outer dia. of seat portion D (mm) 11.80 | 11.85 | 11.90 | 11.95 | 12.00 | 12.10 | 12.20 | 12.40 | 12.70 | 12.80 |
|---|---|---|---|---|---|---|---|---|---|---|---|
| | | Dia. difference D − d (mm) −0.1 | −0.05 | 0 | 0.05 | 0.1 | 0.2 | 0.3 | 0.5 | 0.8 | 0.9 |
| M14 | Biting occurrence rate (%) | 13 | 10 | 6 | 5 | 4 | 3 | 3 | 2 | 2 | 2 |
| M12 | Biting occurrence rate (%) | 26 | 19 | 17 | 15 | 15 | 13 | 4 | 2 | 3 | 3 |
| M10 | Biting occurrence rate (%) | 29 | 23 | 19 | 17 | 16 | 13 | 5 | 3 | 4 | 3 |
| M10-M14 | Airtightness evaluation | Good | Good | Good | Good | Good | Good | Good | Good | Good | Fair |

TABLE 6

| Thread dia. | | Front end outer dia. of seat portion D (mm) 11.80 | 11.85 | 11.90 | 11.95 | 12.00 | 12.10 | 12.20 | 12.40 | 12.70 | 12.80 |
|---|---|---|---|---|---|---|---|---|---|---|---|
| | | Dia. difference D − d (mm) −0.1 | −0.05 | 0 | 0.05 | 0.1 | 0.2 | 0.3 | 0.5 | 0.8 | 0.9 |
| M14 | Biting occurrence rate (%) | 10 | 7 | 3 | 2 | 1 | 0 | 0 | 0 | 0 | 0 |
| M12 | Biting occurrence rate (%) | 12 | 9 | 4 | 3 | 2 | 1 | 0 | 1 | 0 | 0 |
| M10 | Biting occurrence rate (%) | 16 | 13 | 3 | 2 | 1 | 1 | 0 | 0 | 0 | 0 |
| M10-M14 | Airtightness evaluation | Good | Good | Good | Good | Good | Good | Good | Good | Good | Fair |

As shown in Tables 5 and 6 and FIGS. 8 and 9, it was found that, by means of increasing the diameter difference (D−d), biting of the metallic shell against the receiving die can be suppressed and that, by means of setting the diameter difference (D−d) to 0.1 mm or greater, biting of the metallic shell against the receiving die can be suppressed quite effectively.

or the difference (D−d) is set to 0.1 mm or greater. Moreover, occurrence of biting can be suppressed more reliably by means of setting the angle between the taper portion and the seat portion to 2.0° or greater, or setting the diameter difference (D−d) to 0.3 mm or greater.

Meanwhile, from the viewpoint of securing airtightness, it is preferred that the angle α is set to 9.0° or less or the diameter difference (D−d) is set to 0.8 mm or less.

Moreover, from the results of the above-described test, it was confirmed that, the smaller the thread diameter of the thread portion, the greater the possibility of occurrence of biting of the metallic shell against the receiving die. In other words, the above-described setting of the angle between the taper portion and the seat portion and the diameter difference (D−d) is particularly meaningful in the case where a metallic shell of a reduced diameter whose thread portion diameter is M12 (12.0 mm) or smaller or M10 (10.0 mm) or smaller and an insulator are fixed together.

Notably, the present invention is not limited to the details of the above-described embodiments, and may be practiced as follows. Needless to say, other applications and modifications which are not illustrated below are possible.

(a) In the above-described first embodiment, the fixing step is performed under the condition that the outer diameter (D) (mm) of the front end of the seat portion is greater than the inner diameter d of the boundary portion between the insertion hole 42 and the taper portion 43 of the receiving die 41 by 0.1 mm or greater. However, the relation in magnitude between the outer diameter D and the inner diameter d is not limited thereto. Accordingly, the seat portion 18 and/or the receiving die 41 may be configured such that the outer diameter D becomes equal to the inner diameter d.

(b) In the above-described embodiments, the angle defined between the axis CL and the taper portion 43 is set to be equal to the angle of the seat surface of the combustion apparatus, and a portion of the seat portion 18 (68) having deformed along the taper portion 43 is brought into contact with the seat surface of the combustion apparatus. However, the above-described embodiments may be modified as follows. The receiving die is configured such that the angle defined between the axis CL1 and the taper portion differs from the angle of the seat surface of the combustion apparatus, and the metallic shell to undergo the fixing step is configured such that the angle of the seat portion becomes equal to the angle of the seat surface of the combustion apparatus. In this case, a portion of the seat portion not having deformed along the taper portion comes into contact with the seat surface of the combustion apparatus. However, biting of the metallic shell against the receiving die can be suppressed effectively as in the above-described embodiments.

(c) In the above-described embodiments, in the fixing step, the insulator 2 and the metallic shell 3 are fixed together by means of forming the crimped portion 21 without heating the metallic shell 3 (by means of performing so-called cold crimping). Alternately, in the fixing step, the insulator 2 and the metallic shell 3 may be fixed together by means of forming the crimped portion 21, while heating the metallic shell 3 through application of electricity thereto (by means of performing so-called hot crimping). Notably, when cold crimping is performed, a larger load must be applied from the pressing die 45 to the metallic shell 3 as compared with the case where hot crimping is performed, and, therefore, biting of the metallic shell 3 against the receiving die 41 is more likely to occur. Accordingly, employment of the technical idea of the present invention is particularly advantageous in the case where the insulator 2 and the metallic shell 3 are fixed together through performance of cold crimping in the fixing step.

(d) In the above-described embodiments, the thread diameter of the thread portion 15 of the metallic shell 3 is 12.0 mm or less. However, the thread diameter of the thread portion 15 is not limited to that size.

(e) Although not described particularly in the above-described embodiments, a noble metal tip formed of a noble metal alloy (e.g., a Pt alloy, an Ir alloy, or the like) may be provided on at least one of the front end portion of the center electrode 5 and the distal end portion of the ground electrode 27.

(f) The above-described embodiments exemplify the case where the ground electrode 27 is joined to the front end portion of the metallic shell 3. However, the present invention can be applied to the case where the ground electrode is formed by means of cutting a portion of the metallic shell (or a portion of a front end metal piece welded to the metallic shell in advance) (see, for example, Japanese Patent Application Laid-Open (kokai) No. 2006-236906).

(g) In the above-described embodiments, the tool engagement portion 20 has a hexagonal cross-section. However, the shape of the tool engagement portion 20 is not limited thereto. For example, the tool engagement portion 20 may have a Bi-Hex (deformed dodecagon) shape [IS022977: 2005(E)] or the like.

Having described the invention, the following is claimed:

1. A method of manufacturing a spark plug having:

a tubular insulator extending in a direction of an axis; and a tubular metallic shell fixed to an outer circumference of the insulator, wherein the metallic shell includes a thread portion to be screwed into an attachment hole of a combustion apparatus, and a seat portion located rearward of the thread portion, and the seat portion comes into close contact with the combustion apparatus when the thread portion is screwed into the attachment hole of the combustion apparatus, the method comprising:

providing a receiving die having an insertion hole into which the thread portion of the metallic shell can be inserted and a taper portion adjacently surrounding an opening of the insertion hole;

inserting the thread portion of a metallic shell into the insertion hole, such that the seat portion of said metallic shell is brought into contact with the taper portion; and applying a pressing force along the axis against a rear end portion of the metallic shell so as to bend a rear end opening portion of the metallic shell radially inward so as to form a crimped portion whereby the insulator and the metallic shell are fixed together, wherein the pressing force is applied to the rear end portion of the metallic shell in a state in which, as viewed on a cross-section including the axis, the angle between the taper portion and the seat portion is made equal to or greater than 0.5°.

2. A method of manufacturing a spark plug according to claim 1, wherein an outer diameter of the front end of the seat portion is made greater than an inner diameter of a boundary portion between the insertion hole and the taper portion by 0.1 mm to 0.8 mm inclusive.

3. A method of manufacturing a spark plug according to claim 2, wherein the outer diameter of the front end of the seat portion is made greater than the inner diameter of the boundary portion between the insertion hole and the taper portion by 0.3 mm or greater.

4. A method of manufacturing a spark plug according to any one of claims 1 to 3, wherein the pressing force is applied to the rear end portion of the metallic shell in a state in which, as viewed on a cross-section including the axis, the angle between the taper portion and the seat portion is made equal to or less than 9.0°.

5. A method of manufacturing a spark plug according to any one of claims 1 to 3, wherein the pressing force is applied to the rear end portion of the metallic shell in a state in which, as viewed on a cross-section including the axis, the angle between the taper portion and the seat portion is made equal to or greater than 1.0°.

6. A method of manufacturing a spark plug according to any one of claims 1 to 3, wherein the thread portion has a thread diameter of 12.0 mm or less.

* * * * *